US005454776A

United States Patent [19]

Ulrich et al.

[11] Patent Number: 5,454,776

[45] Date of Patent: Oct. 3, 1995

[54] CARTON BOTTOM FOLDER AND SEALER

[75] Inventors: Lawrence W. Ulrich; Conrad Walker, both of Darien; James Lojewski, Bartlett, all of Ill.

[73] Assignee: Durable Packaging Corporation, Chicago, Ill.

[21] Appl. No.: 136,547

[22] Filed: Oct. 14, 1993

[51] Int. Cl.[6] ..... B31B 1/52; B31B 1/72

[52] U.S. Cl. ..... 493/117; 493/183; 493/179; 53/377.2; 53/387.2

[58] Field of Search ..... 493/114, 115, 493/116, 117, 147, 156, 157, 183, 162, 127, 156, 383, 382; 53/136.4, 376.4, 377.2, 378.3, 387.2; 156/468, 355, 443

[56] References Cited

U.S. PATENT DOCUMENTS

| | | | |
|---|---|---|---|
| 4,044,527 | 8/1977 | Ulrich et al. | 53/137 |
| 4,079,577 | 3/1978 | Ulrich et al. | 53/374 |
| 4,173,105 | 11/1979 | Ulrich et al. | 53/374 |
| 4,364,219 | 12/1982 | Luyett et al. | 53/374 |
| 4,392,911 | 7/1983 | Ulrich et al. | 156/468 |
| 4,398,381 | 8/1983 | Ulrich et al. | 53/393 |
| 4,438,617 | 3/1984 | Ulrich et al. | 53/137 |
| 4,525,980 | 7/1985 | Ulrich et al. | 53/374 |
| 4,537,649 | 8/1985 | Ulrich et al. | 156/355 |
| 4,542,616 | 9/1985 | Ulrich et al. | 53/137 |
| 4,579,551 | 4/1986 | Ulrich et al. | 493/23 |
| 4,632,666 | 12/1986 | Ulrich et al. | 493/23 |
| 4,889,581 | 12/1989 | Ulrich et al. | 156/443 |
| 4,892,513 | 1/1990 | Kwiek | 493/316 |
| 5,112,288 | 5/1992 | Ulrich et al. | 493/27 |

OTHER PUBLICATIONS

SOCO System brochure on Carton Sealers, no date.

SOCO System Promotional Sheet on Special Purpose Machines and Plany Lay–Out, no date.

SOCO System Promotional Sheet on Accessories, no date.

Durable Packaging Corp. Promotional Sheet on "Power–Form" Case Erectors, no date.

*Primary Examiner*—Bruce M. Kisliuk

*Assistant Examiner*—Christopher W. Day

*Attorney, Agent, or Firm*—Dressler, Goldsmith, Shore & Milnamow, Ltd.

[57] ABSTRACT

An apparatus for infolding and sealing the side and end bottom flaps of a carton includes a unique bottom side flap infolding system comprising flap infolding arms mounted to rotary cylinders for automatically infolding and supporting the bottom side flaps. The rotary cylinders are actuated by a sensor which senses the presence or absence of a carton in the apparatus. The apparatus also includes a unique assembly comprising downwardly inwardly inclined rollers mounted to the conveyor side arm assemblies to urge the carton downward toward the lower sealing head to assure a complete and continuous bottom seal. The apparatus may also include transversely adjustable guardrails, a hold down flange to maintain the carton against the packing plate and a carton urging assembly for urging the carton through the apparatus.

24 Claims, 7 Drawing Sheets

CARTON BOTTOM FOLDER AND SEALER

FIELD OF THE INVENTION

This invention generally relates to apparatus for infolding and sealing the side and end bottom flaps of cartons and more particularly to an apparatus for infolding the side and end bottom flaps and assuring positive contact with the bottom sealing head for properly sealing the carton's bottom flaps.

BACKGROUND OF THE INVENTION

In the packaging industry, corrugated and fiberboard cartons have been used for many years. Various machines have been developed which are capable of sealing such cartons either by gluing the flaps, taping the flaps or by stapling or otherwise securing the flaps by fasteners to maintain the flaps in a closed position. Many of these machines are designed to accept cartons of random width and height by providing various types of means to manually and automatically control the transverse movement of side-arm assemblies associated therewith and the vertical movement of the top head sealing assembly. Examples of such machines are disclosed in U.S. Pat. Nos. 4,044,527, 4,079,577 and 4,173,105 which patents have the same inventive entity and assignee as the present invention.

Machines are also known in the industry which erect cartons from the folded or knockdown form to the erected rectangular form for use. Previously known apparatus received knockdown cartons stacked in a substantially vertical orientation in a magazine section awaiting erection. Suction cups mounted on a pivot arm assembly secure the carton blank and move it from the magazine section to a setup section. Movement of the pivot arm from the magazine section to the setup section with the carton blank secured therein is effective to set up the carton blank into a tubular form. The flap folding section infolds the trailing bottom and end flaps and side bottom flaps through longitudinal extending plow members in converging side plow beams as the cartons move through the flap folding sections. Examples of such machines are disclosed in U.S. Pat. Nos. 4,579,551, 4,632,666, 4,892,513 and 5,112,288 which patents have the same assignee as the present invention.

Another device is known in the industry which retains the bottom flaps of the carton in their infolded position prior to sealing in a manner which permits the filling of the carton. This is a simple device which consists of a base plate to which a pair of upwardly and outwardly longitudinally extending flap retaining flanges are mounted. Flap retaining flanges are mounted a short distance from the base plate to receive and retain the corresponding side flaps of a carton therebetween. The carton can then be packed while the flaps are maintained in their closed position. An example of this device is disclosed in U.S. Pat. No. 4,398,381, which patent has the same inventive entity and assignee as the present invention.

SUMMARY OF THE INVENTION

The carton bottom flap folding and sealing apparatus of the present invention accepts cartons in the tubular form and infolds the bottom trailing and side flaps and urges the carton downward toward the bottom sealing head to effect a more uniform and complete seal of the bottom flaps. In accordance with a preferred embodiment of the invention, a carton bottom folding and sealing apparatus is provided that includes a carton infeed section, a bottom flap folding section, a sealing section, an outfeed section, and a conveyor to convey the carton from the bottom flap folding section through the sealing section and to the outfeed section. The invention includes a system to urge the carton downward as it enters the conveyor to assure contact with the bottom sealing head and to provide a more uniform and complete bottom flap seal.

More specifically, the carton infeed section is provided with a downwardly inwardly inclined plate to direct the bottom trailing end flap to the infolded position. The carton is then moved to the bottom flap folding section which includes a generally horizontal plate to support the carton bottom, a pair of pivotally mounted arms mounted to rotary cylinders, an electro-pneumatic actuation system for pivoting the arms, and a sensor for sensing the presence or absence of a carton from the bottom flap folding section. The carton can simultaneously be packed with any goods to be packaged while in the bottom flap folding section. The carton is then moved into the conveyor section to transport the carton past and above the bottom sealing head at the front or beginning of the conveyor section. The apparatus is provided with a system to urge the carton downward toward the bottom sealing head. This downward urging assures better contact with the bottom sealing head and a more uniform and complete seal of the bottom flaps of the carton.

The system includes a plurality of downwardly forwardly inclined rollers which are substantially coplanar with the belts of the conveyor section. As the carton is engaged by the rollers and transported forward by the moving conveyor belts, the inclined rollers urge the carton downward toward the bottom sealing head. In doing so, the carton is assured of better contact with the bottom sealing head.

Optionally, the carton bottom flap folding and sealing apparatus may include transversely adjustable guard rails mounted to the frame, with contact surfaces to prevent the carton from binding as it moves through the apparatus. In a preferred embodiment, the contact surfaces are fabricated from a low friction material such as Teflon™. Additionally, the apparatus may include a hold down flange to assure that the carton remains in a substantially horizontal plane while the bottom flaps are infolded. The apparatus may also include a carton urging assembly to urge the carton through the apparatus.

DETAILED DESCRIPTION OF THE PREFERRED EMBODIMENTS

Figure 1:
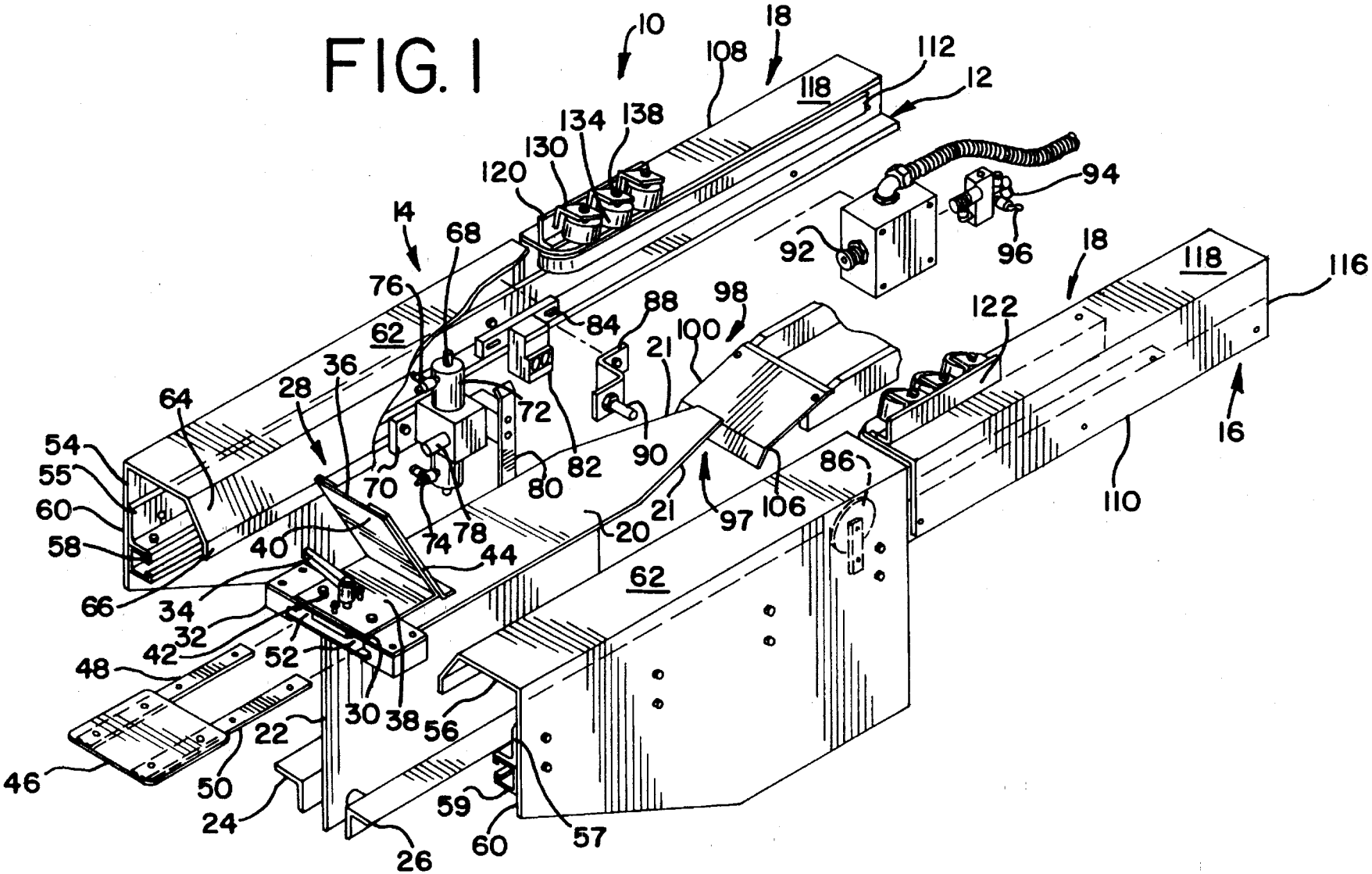
FIG. 1 is an exploded perspective view, partially broken away, showing portions of a carton sealing apparatus constructed in accordance with the present invention.
Figure 2:
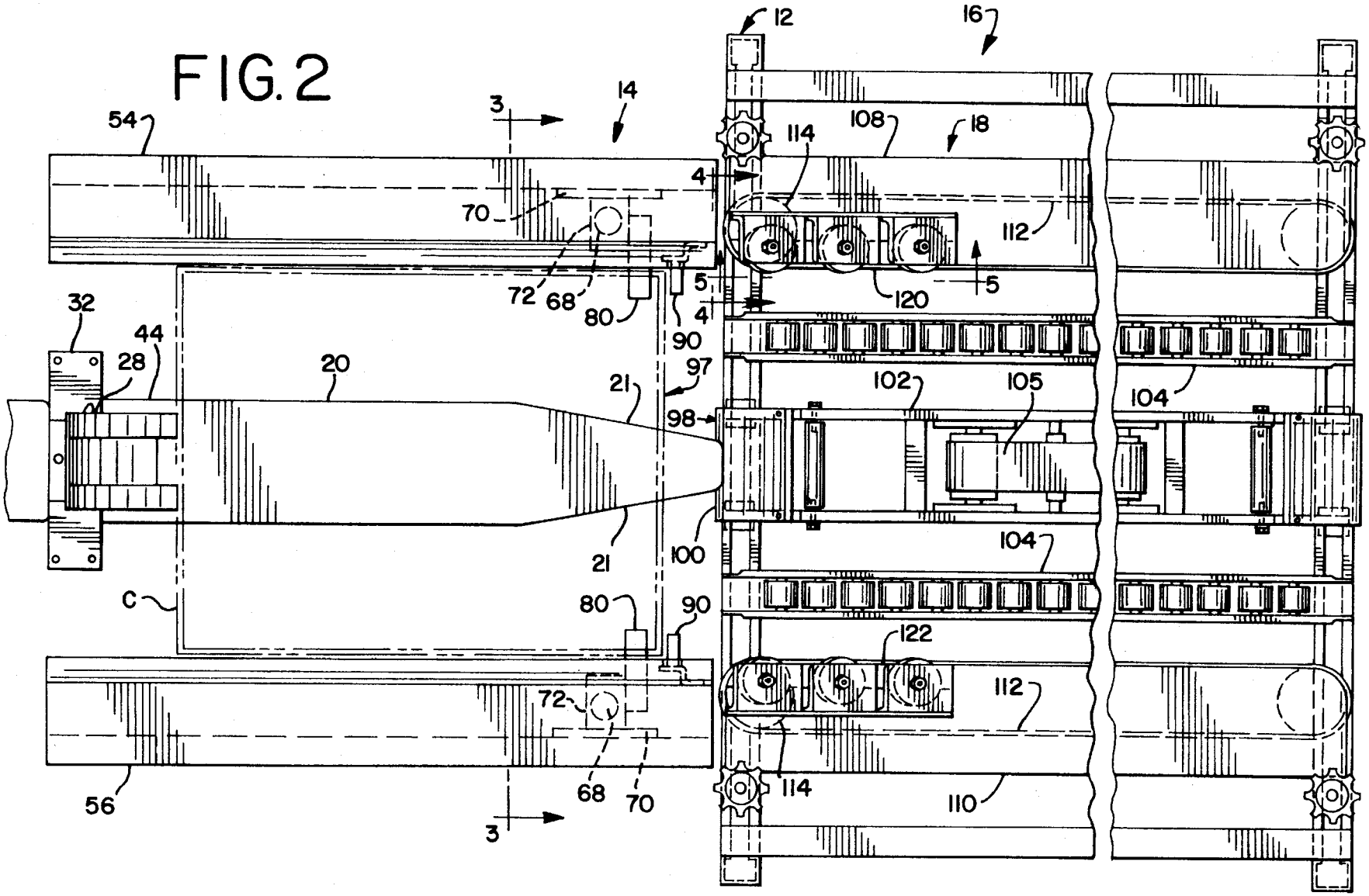
FIG. 2 is a top plan view, partially broken away, showing a carton sealing apparatus constructed in accordance with the present invention.

Referring generally to FIGS. 1 and 2, there is shown a carton folding and sealing apparatus 10 constructed in accordance with the present invention. Sealing apparatus 10 is generally of the type shown in U.S. Pat. No. 4,392,911, the disclosure of which patent is incorporated herein by reference. Apparatus 10 comprises a frame 12, a packing and folding section 14, a sealing section 16, and a conveyor 18 to move a carton C therethrough. The folding section 14 has a packing plate 20, which is a substantially horizontal plate having inwardly angled sides 21 at the inner end thereof. Packing plate 20 is fixedly mounted to a vertical plough plate 22 that is attached to frame 12 by left and right plough supports 24, 26. Packing plate 20 has a flap assist assembly 28 that is slidably mounted to the end feed side 30 thereof. Assembly 28 comprises a slide guide 32 comprising a transverse fitting slidably mounted to packing plate 20 and a hand lever 34 for selectively fixing the position of guide 32.

A trailing end flap folder plate 36 is a formed or bent plate having a substantially horizontal leg portion 38 and an inclined leg portion 40. Leg portion 40 is fixedly mounted to guide 32 by bolts 42 or other suitable means. Inclined plate 40 is downwardly inclined in the direction of movement of carton C as shown generally in FIG. 1. Flap assist guides 44 are secured to inclined leg 40 and have a bottom strip which extends slightly onto packing plate 20. An optional plate 46 having left and right mounting members 48, 50 attached may be provided to extend the length of plate 20 to accommodate larger cartons. Plate 46 is secured to packing plate 20 by bolts or other appropriate means.

Left and right guard plates 54, 56 are mounted to support angles 55, 57, which are attached to side arms 108, 110. Guard plates 54, 56 are mounted equidistant from and in mirror image relation to each other relative to packing plate 20. Guard plate 54, has an inverted generally J shape with a first vertical wall 60. The upper end of vertical wall 60 forms a horizontal wall 62 contiguous with an inclined wall 64 and terminating in a second vertical wall 66. Guard 56 is formed similar and in mirror image relation to guard 54.

Figure 3:
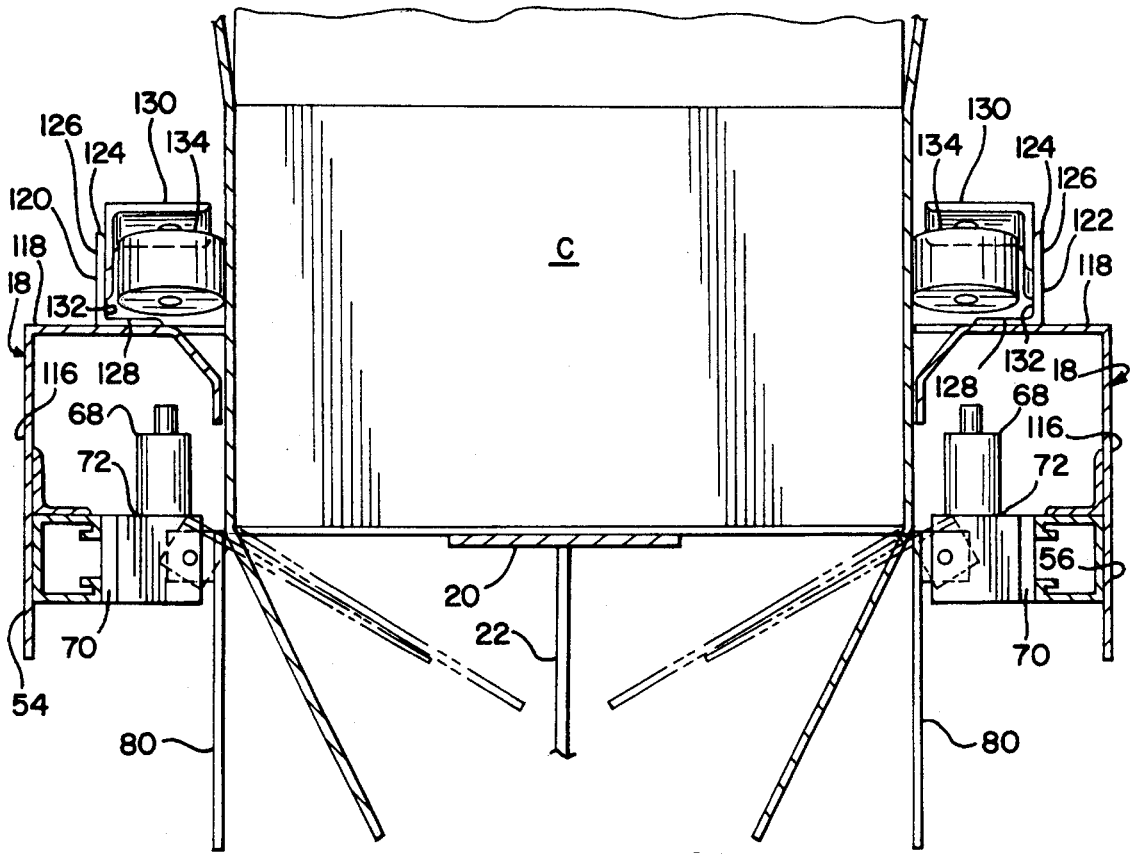
FIG. 3 is an enlarged sectional view taken along line 3—3 in FIG. 2.

A pair of rotary cylinders 68 as best seen in FIG. 1, where one cylinder is illustrated and is representative of both, are fixedly mounted to support plates 70 that are respectively slidably mounted to support channels 58, 59 in spaced relation to each other and to packing plate 20. Rotary cylinders 68 are mounted slightly offset relative to each other, as best seen in FIG. 2. Each rotary cylinder 68 includes a housing 72, a pair of flow control valves 74, 76, and a pivot pin 78 pivotally mounted thereto and extending therefrom. An articulating flap folder arm 80 is attached to pin 78 and is pivotal therewith. As best seen in FIG. 3, flap folder arm 80 pivots upward and inward relative toward packing plate 20 in a plane which is transverse to the direction of movement of carton C, between a first position wherein arm 80 is in a substantially vertical position and a second position wherein arm 80 is in a substantially horizontally position.

A sensor assembly 82, such as an exemplary photocell, is mounted to a bracket 84, which is mounted to the inside of left guard plate 54. A reflector 86 is mounted on right guard plate 56 in about mirror relation to sensor 82. Z brackets (one shown) 88, which each have a dowel 90 extending inwardly therefrom, are mounted to left and right guard plates 54, 56, in a plane slightly below that of packing plate 20.

A suitable electrical connector box 92 is mounted to frame 12 and provides power and control signals through wiring (not shown) to the various parts of the apparatus 10 which so require. A suitable power control valve 94 is mounted in close proximity to box 92 for electrical connection therebetween. Tubing 96 is connected to valve 94 and is routed to flow control valves 74, 76 for pneumatic connection therebetween.

As best seen in FIGS. 1 and 2, sealing section 16 is located adjacent to outfeed end 97 of folding section 14. Sealing section 16 has an infeed area 98, a feed plate 100, a carton support assembly 102, carton roller assemblies 104 and a bottom flap sealing head 105. Feed plate 100 is a slightly upwardly inclined plate located at the infeed area 98. The inlet end 106 of plate 100 is at an elevation slightly below the plane of packing plate 20. Carton support assembly 102 and carton roller assemblies 104 are longitudinally mounted to frame 12 and are substantially coplanar with packing plate 20 such that a carton C will traverse the entire apparatus in substantially the same horizontal plane.

A conveyor generally shown at 18 is of the type as disclosed in the aforereferenced U.S. Pat. No. 4,392,911 and comprises a pair of opposing sidearms 108, 110 mounted to the frame 12 in spaced relation to each other. Each of the sidearms 108, 110 houses an endless belt 112 which travels around spindles 114 to convey a carton C through the sealing section 16. As best seen in FIG. 1, sidearms 108, 110 have a vertical outer wall 116 and a horizontal upper wall 118 which extends along the length of the conveyor 18. Sidearms 108, 110 are either manually or automatically moveable toward and away from one another in order to accommodate cartons of different widths.

Figure 4:
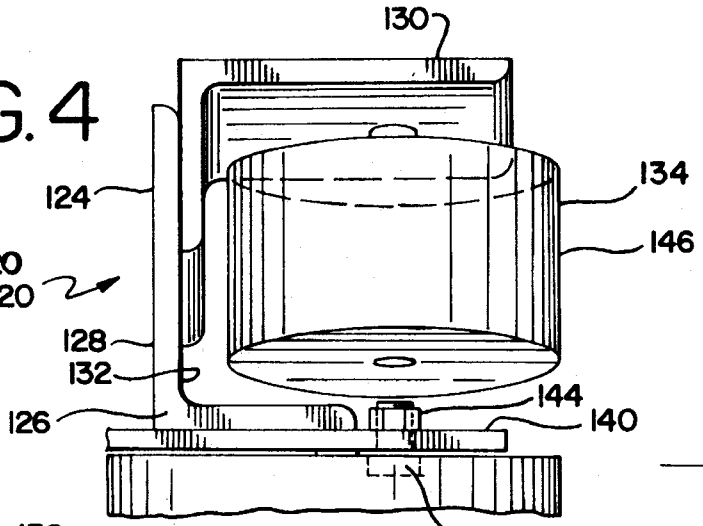
FIG. 4 is an enlarged sectional view taken along line 4—4 in FIG. 2.
Figure 5:
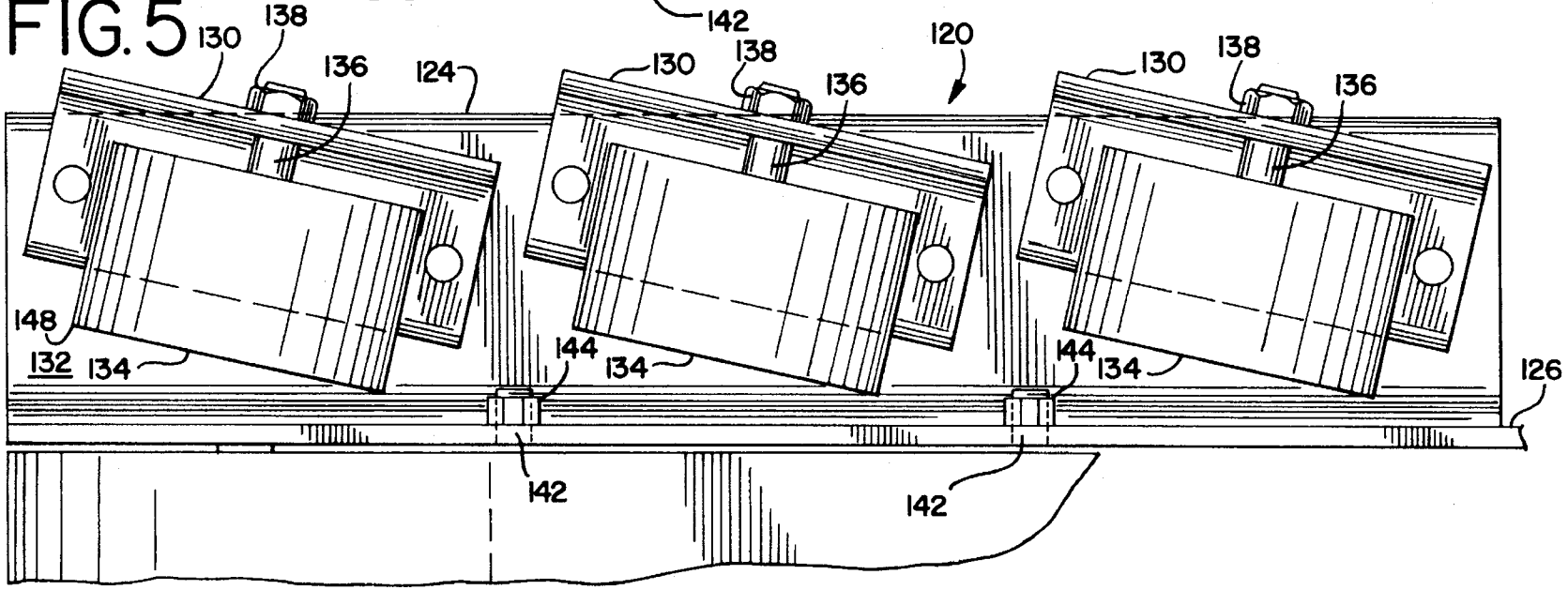
FIG. 5 is an enlarged sectional view taken along line 5—5 in FIG. 2.

As best illustrated in FIGS. 4 and 5, inclined roller sets 120, 122 are adjustably mounted to upper wall 118 of each of the sidearms 108, 110. Each of the inclined roller sets 120, 122 has a roller set mounting bracket 124, which is a formed angle and which has a horizontal leg 126 and a vertical leg 128. Roller mounts 130 are secured to the inner surface 132 of vertical leg 128 by means such as bolting or welding. Rollers 134 have associated axles 136 and are mounted to the roller mounts 130 by nuts 138 which engage threads (not shown) on the end of axles 136. This mounting arrangement allows rollers 134 to freely rotate about their respective axes. Roller mounts 130 are secured to bracket 124 such that the plane of rotation of roller 134 is downwardly inclined in the direction of travel of carton C through conveyor 18.

Roller set mounting bracket 124 is mounted to sidearms 108, 110 by adjustable or removable means such as bolting. To this end, horizontal leg 126 has a plurality of transversely slotted or elongated holes 140 extending therethrough which align with holes in the upper wall 118 of sidearms 108, 110. Bolts 142 which extend therethrough are tightened by an associated nut 144 to secure bracket 124 in a predetermined location. The slotted holes 140 allow for transverse adjustment of bracket 124.

Bracket 124 is transversely positioned on sidearm 108 such that the outer periphery shown at 146 of roller 134, when it is at its closest point to the longitudinal center axis of apparatus 10, is substantially vertically coplanar with endless belt 112. Bracket 124 is longitudinally positioned on sidearm 108 such that the leading edge shown at 148 of roller 134 engages carton C in a plane somewhat behind the vertical plane defined by the forward-most portion of belt 112.

Bottom flap sealing head 105 is mounted to frame 12 generally below the plane of travel of carton C as defined by carton support assembly 102 and roller assemblies 104. Sealing head 105 is positioned downstream of roller sets 124 and applies a seal, such as a strip of tape, to the bottom flaps and leading and trailing panels of the carton as the carton passes overhead.

In operation, carton C in a tubular form, with the leading end and trailing end flaps, and the side flaps in a downward orientation is positioned above and in front of apparatus 10 at the folding section 14. The leading end flap is infolded as carton C is moved downward against plate 20 in folding section 14. This same downward movement with a slight force on carton C contacts the trailing end flap against trailing end flap folder plate 36. The slight downward force urges the trailing end flap forward into its constructed or infolded position while at the same time urges the carton C forward along packing plate 20.

As illustrated in FIG. 3, in the rested position, the leading and trailing end flaps rest upon the upper surface of packing plate 20. As the carton is moved into this position, the front edges of the bottom side flaps contact dowel 90. As the flaps contact the dowels 90, any out-of-square shape which the carton may have had is corrected, and the carton is adjusted to a substantially rectangular shape. While in the resting position, the carton C breaks the line of optical communication between sensor 82 and reflector 86, which actuates a control circuit that controls power control valve 94.

Upon actuation, valve 94 transmits a pneumatic signal which actuates flow control valves 74, 76. Actuation of valves 74, 76 causes flap folding arms 80 to move from their vertical position to their horizontal position. Arms 80 contact the bottom side flaps and move them into their infolded or constructed position, as shown in FIG. 3, where the flaps are shown in an intermediate position. Arms 80 remain in the horizontal or infolded position for the entirety of the period during which the carton obstructs the line of optical communication between sensor 82 and reflector 86.

Contemporaneous with the bottom flaps infolding operation, the operator can pack the carton with items for shipment. Used in this manner, packing plate 20 serves to stabilize the carton C while the operator packs the carton. Alternatively, packing can be performed at another location and the apparatus 10 can be used simply to infold and seal the carton bottom flaps.

When packing is complete, or in the alternative operation above discussed wherein the carton C is to be packed at a later time, the carton C is moved into the sealing section 16 by way of conveyor 18. As the carton C is urged forward, arms 80 retain the bottom flaps in the infolded position while moving carton C from packing plate 20 onto support assembly 102. During this operation the leading edges of the bottom flaps may tend to drop. This however is prevented by feed plate 100 which provides a surface to guide the bottom flaps back into the fully infolded position.

The carton is then moved up to a point of engagement with belts 112 for conveying the carton through sealing section 16. Substantially contemporaneously with engagement with belts 112, carton C also engages the leading edge 148 of rollers 134. As the carton continues to traverse therethrough, engagement with rollers 134 urges the carton downward which results in a slight downward pressure onto support assembly 102 and roller assemblies 104. The continued downward pressure on the carton results from the rotational plane of rollers 134 which is directed downward onto the support assemblies 102 and towards the bottom sealing head 105. The downward urging of rollers 134 assures better, more complete contact of carton C with the sealing head 105 to provide a complete and continuous bottom seal.

With respect to the alignment of roller sets 120, 122, it is important to note that the plane formed by the outermost periphery 146 of rollers 134 should be to the maximum extent possible, in the same vertical plane as belts 112. This assures that the carton C will sufficiently contact belt 112 for conveyance while being urged downward toward the sealing head 105. Misalignment of roller sets 120, 122 and belt 112 can be easily corrected by adjustment effectuated as earlier provided.

Figure 6:
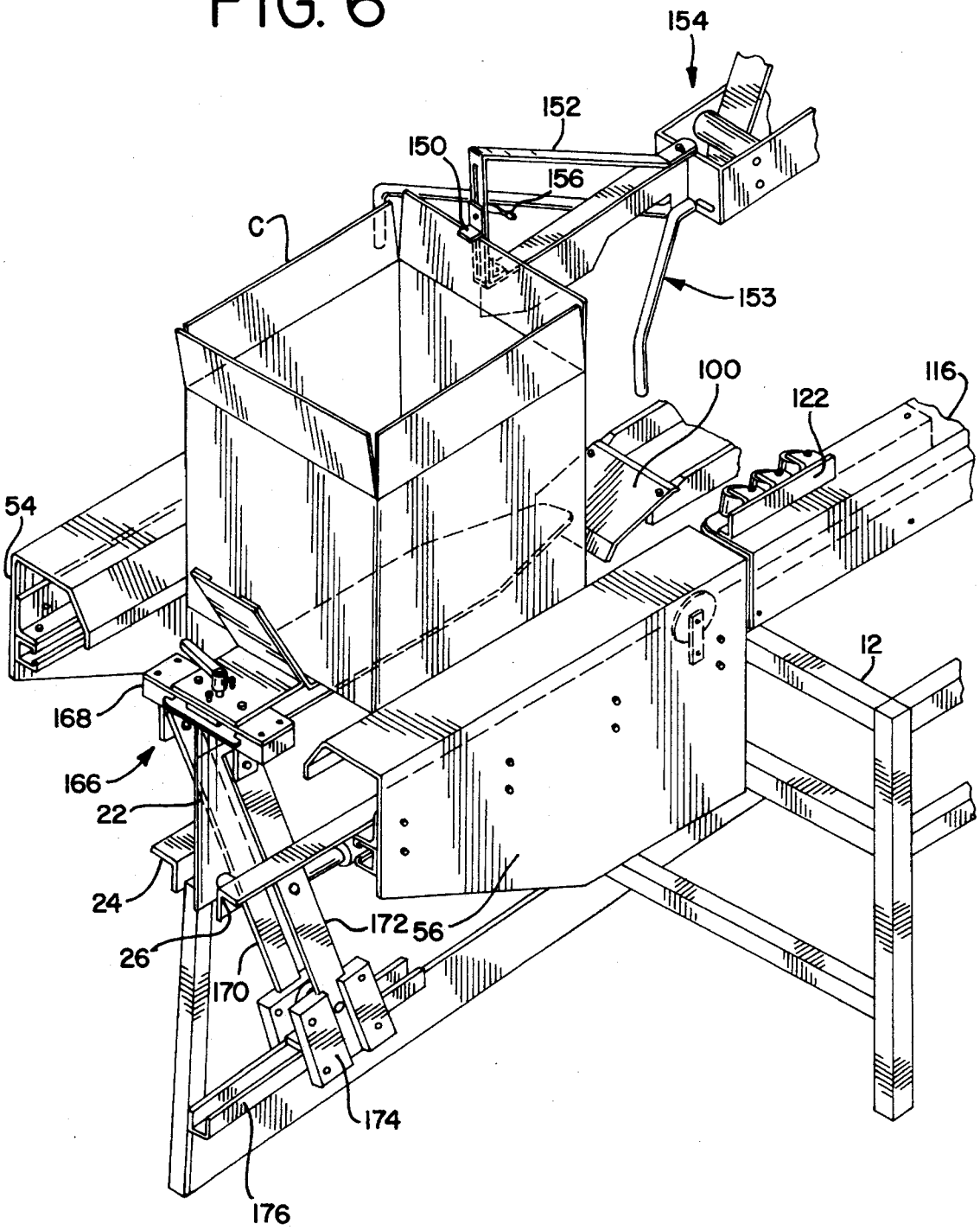
FIG. 6 is a perspective view, partially broken away, showing portions of a carton sealing apparatus and attendant optional features constructed in accordance with the present invention.

The apparatus 10 hereinabove discussed can further include optional features. One optional feature is a top flap sealing head, as provided in the aforereferenced U.S. Pat. No. 4,392,911, which provides for automatic top flap closure and sealing. Thus, the apparatus as equipped, can fully infold and seal a carton C while allowing sufficient time for packing pendent with the overall operation. Another such feature which is shown in FIG. 6, is an adjustable hold-down flange 150. Hold-down flange 150 is adjustably mounted to a bracket 152 which, in a preferred construction is mounted to a top-flap infolding assembly 153. The top-flap infolding assembly 153 is mounted to the top sealing head 154. Hold-down flange 150 contacts the top leading flap of the carton C which serves to hold the carton C on the packing plate 20 surface while the bottom flaps are infolded. A handled bolt arrangement 156 fastens hold-down flange 150 to bracket 152 which provides sufficient rigidity while affording a readily adjustable configuration to accommodate cartons of various sizes.

Figure 8:
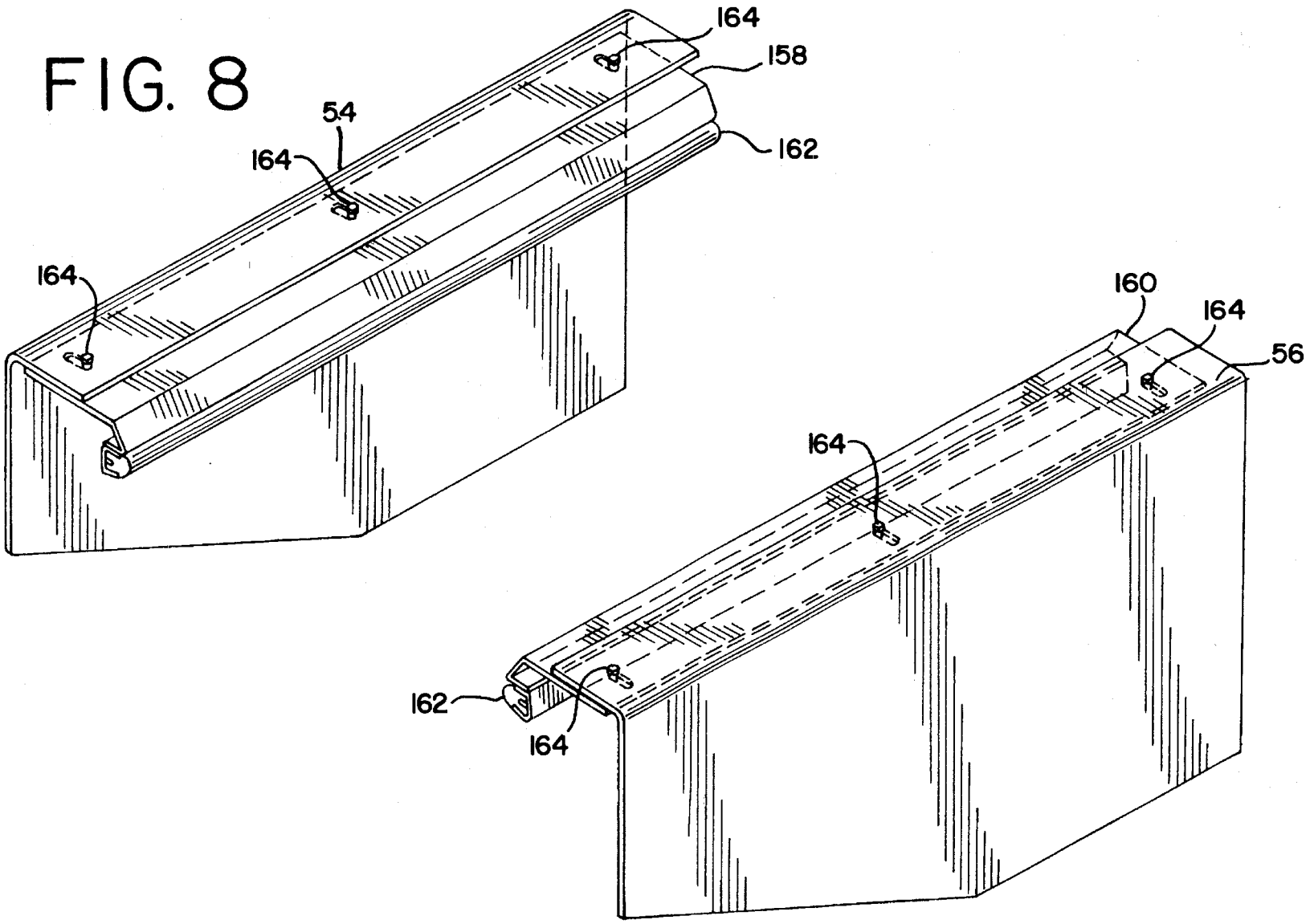
FIG. 8 is a perspective view of adjustable lateral arms for use in combination with the carton sealing apparatus of the present invention.

Other features provide for automatic transverse adjustment of sidearm assemblies 108, 110 for accommodating cartons of various sizes without stopping operations for adjusting the apparatus. Reference is made to U.S. Pat. No. 4,044,527 for a disclosure of an apparatus that automatically adjusts the sidearms. Optionally, as best seen in FIG. 8, left and right guard plates 54, 56 can include inwardly laterally adjustable arms 158, 160. Each of the arms 158, 160 has a contact surface 162 which extends along the innermost portion thereof to contact the carton C as it traverses between the arms 158, 160.

Contact surfaces 162 are preferably fabricated from a low friction fluorine containing resin material such as Teflon™ or the like, to prevent the carton C from binding in the apparatus 10. In a preferred construction, lateral arms 158, 160 are fastened to guard plates 54, 56 by bolts 164 or other suitable means to facilitate adjustment as necessary.

Figure 7:
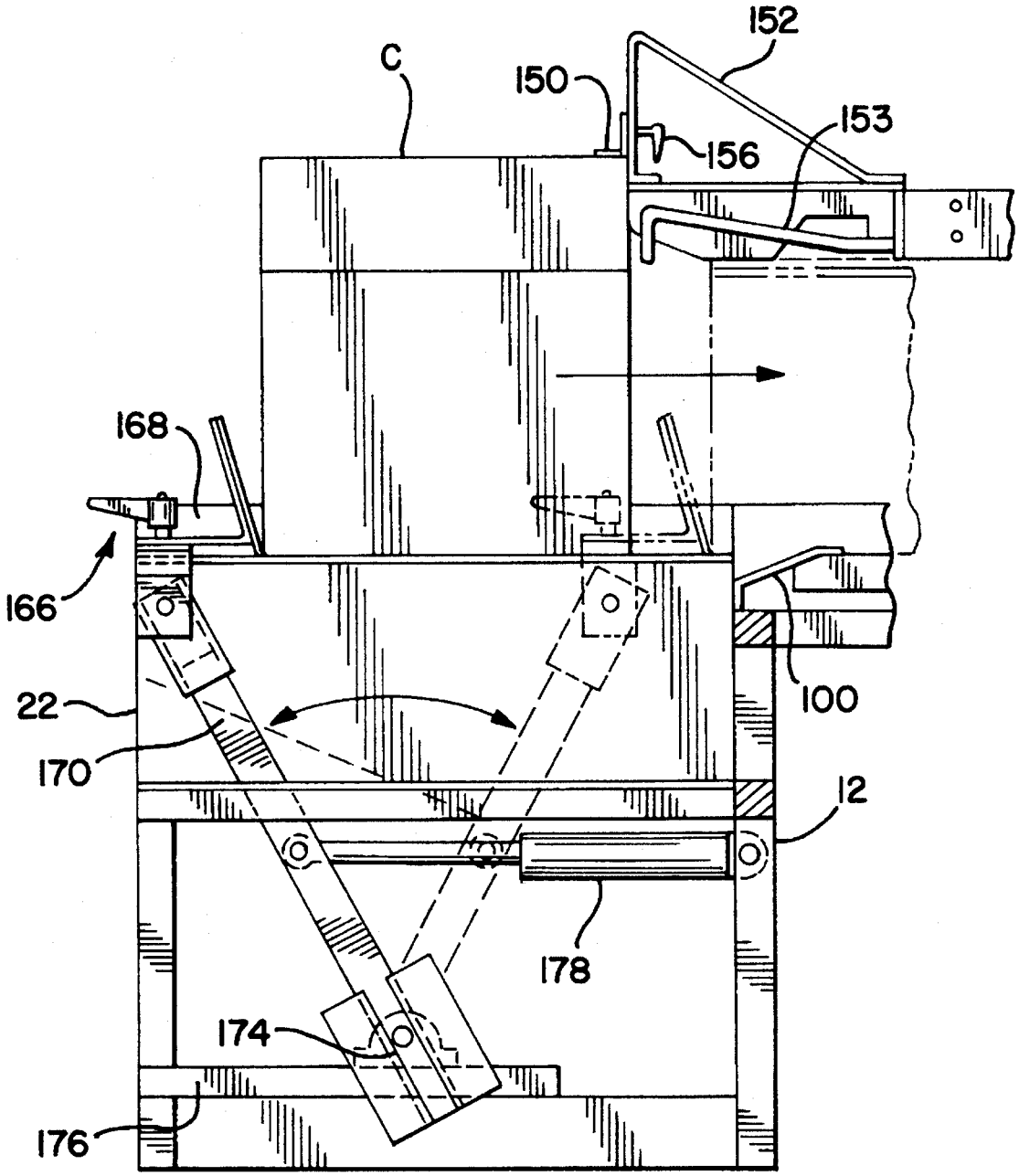
FIG. 7 is a side view, partially broken away, of a carton sealing apparatus showing an optional automatic carton urging assembly.

An additional feature which can be provided as part of the carton folding and sealing apparatus 10, is an automatic carton urging assembly shown generally at 166 in FIGS. 6 and 7. The urging assembly 166 includes a sliding flap assist assembly 168 which is mounted to packing plate 20, and which slides thereon in a direction axial to the direction of travel of carton C. Urging assembly 166 has two arms 170, 172 which are mounted to flap assist assembly 168 on one end and pivotally mounted to frame 12 by a bearing assembly 174 on the other end. Bearing assembly 174 is fixedly mounted to frame 12; however, assembly 174 is adjustable along track 176 to accommodate cartons of various sizes.

About mid-way along arms 170, 172 between bearing assembly 174 and flap assembly 168, one end of an actuator 178, such as a pneumatic or hydraulic piston type cylinder, is fastened to arms 170, 172. The opposite end of actuator 178 is mounted to frame 12 such that extension or retraction of the actuator 178 moves arms 170, 172 in the direction as shown by the two-headed arrow illustrated in FIG. 7. To provide an essentially planar movement of flap assembly 168 along packing plate 20, arms 170, 172 are slidably mounted in bearing assembly 174 such that the arms 170, 172 are extended when the flap assist 168 is in the fully forward (solid lines) or rearward (broken lines) position as illustrated in FIG. 7. Conversely, arms 170, 172 are in the retracted position when flap assist assembly is directly above bearing assembly 174, or at the mid-point of travel.

In use of the apparatus 10 with the attendant hold-down flange 150 and urging assembly 166, a carton C is placed in apparatus 10 and positioned as illustrated in FIG. 6. In this position, the carton C can be packed and prepared for sealing accordingly. Contemporaneous with packing, the bottom side flaps are infolded as provided in an earlier discussion herein. During the infolding operation, the carton C is held in place vertically with respect to the apparatus 10 by the hold-down flange 150.

Upon completion of the packing operation, a foot switch (not shown) or other control means is operated to actuate actuator 178 to urge carton C from the position shown in FIG. 6, through the travel sequence as illustrated in FIG. 7. To begin the top flap infolding operation, the top trailing flap is manually infolded. Then, during the travel sequence, the top leading flap is infolded as are the top side flaps. As previously described, while the carton C traverses through the apparatus 10, a seal is applied to the bottom and top flaps of the carton by sealing heads 105, 154 accordingly.

From the foregoing, it will be observed that numerous modifications and corrections can be effected without departing from the true spirit and scope of the novel concepts of the present invention. It will be understood that no limitation with respect to the specific embodiments illustrated herein is intended or should be inferred. It is of course intended to cover by the appended claims all such modifications as fall within the scope of the claims.

What is claimed:

1. A carton sealing apparatus for sealing the bottom flaps of a carton, the carton having a leading side, a trailing side, and a pair of opposing sides; comprising:

(a) a frame structure;

(b) a sealing head mounted to said frame structure;

(c) a pair of opposing side arms mounted to the frame structure, said side arms having endless conveyor belts engageable with the opposing sides of the carton; and (d) a plurality of longitudinally spaced apart rollers mounted to at least one of said side arms, said rollers being downwardly inclined toward said sealing head, and being engageable with at least one of the opposing sides of the carton so as to urge the carton downward as it passes above said sealing head.

2. The invention as defined in claim 1 further comprising a bracket having a horizontal leg and a vertical leg, said vertical leg having a plurality of roller mounting members extending therefrom for mounting said rollers thereto.

3. The invention as defined in claim 2 wherein said horizontal leg having at least two transverse slotted holes for adjustably mounting said bracket to said side arm.

4. The invention as defined in claim 2 having from about 2 to about 6 rollers mounted to each of said brackets.

5. The invention as defined in claim 1 wherein said plurality of rollers are mounted to each of said side arms.

6. The invention as defined in claim 1 further including a pair of opposing guard plates mounted to said side arms, said guard plates being mounted adjacent to and substantially axially coplanar with said side arms, said guard plates being positioned to define a path therebetween for movement of a carton therethrough.

7. The invention as defined in claim 6 wherein said guard plates comprise a first portion mounted to said side arms and a second portion transversely adjustably mounted to said first portion.

8. The invention as defined in claim 6 wherein each of said guard plates further includes a contact surface extending along at least a portion thereof closest to said path for guiding a carton through said apparatus.

9. The invention as defined in claim 8 wherein said contact surfaces are a low friction material.

10. A carton sealing apparatus for sealing the bottom flaps of a carton, the carton having a leading side, a trailing side, and a pair of opposing sides; comprising:

(a) a frame structure;

(b) a sealing head mounted to said frame structure;

(c) a pair of opposing side arms mounted to said frame structure, said side arms having endless conveyor belts engageable with the opposing sides of the carton, said side arms being transversely movable toward and away from one another for accommodating cartons of different widths;

(d) a bottom flap folder assembly, said bottom flap folder assembly including a substantially horizontal plate positioned substantially coplanar with said sealing head, and at least a pair of pivotally mounted arms for pivoting between a first position wherein said arms being in a substantially vertical position and a second position wherein said arms being in a substantially horizontal position for infolding the carton bottom side flaps, said pivotally mounted arms being mounted to said side arms and being transversely movable therewith for accommodating the infolding of the carton bottom side flaps of cartons having different widths; and (e) means for pivoting said arms between said first and second positions.

11. The invention as defined in claim 10 wherein said means for pivoting includes an electro-pneumatic valve operably connected to at least a pair of rotary cylinders, said pivotally mounted arms being mounted to said cylinders.

12. The invention as defined in claim 10 further including a sensor for sensing the presence of a carton, said sensor controlling the actuation of said pivoting means.

13. The invention as defined in claim 10 further comprising a carton urging assembly mounted to said frame structure for moving a carton from a first position wherein said carton is engaged by said bottom flap folder assembly to a second position wherein said carton is engaged by said endless conveyor belts for traversing the carton through said carton sealing apparatus.

14. The invention as defined in claim 13 further including an actuator for moving said carton urging assembly from said first position to said second position.

15. The invention as defined in claim 10 further including a top sealing head mounted to said frame structure for applying a seal to a carton having top flaps being in an infolded position, said top sealing head having a hold-down flange mounted thereto for maintaining contact between said carton and said horizontal plate during infolding of said carton bottom flaps.

16. A carton sealing apparatus for sealing the bottom flaps of a carton, the carton having a leading side, a trailing side, and a pair of opposing sides; comprising:

(a) a frame structure;

(b) a sealing head mounted to said frame structure;

(c) a pair of opposing side arms mounted to said frame structure, said side arms having endless conveyor belts engageable with the opposing sides of the carton;

(d) a plurality of longitudinally spaced apart wheels mounted to at least one of said side arms that are engageable with at least one of the opposing sides of the carton so as to urge the carton downward as it passes above said sealing head;

(e) a bottom flap folder assembly, said bottom flap folder assembly including a substantially horizontal plate positioned substantially coplanar with said sealing head, and at least a pair of pivotally mounted arms for pivoting between a first position wherein said arms being in a substantially vertical position and a second position wherein said arms being in a substantially horizontal position for infolding the carton bottom side flaps; and (f) means for pivoting said arms between said first and second positions.

17. The invention as defined in claim 16 further including a downwardly inwardly inclined plate slidably mounted to said horizontal plate, said inclined plate being axially movable along said horizontal plate and having clamping means for clamping said inclined plate thereto.

18. The invention as defined in claim 16 further including a pair of opposing guard plates mounted to said side arms, said guard plates being mounted adjacent to and substantially axially coplanar with said side arms, said guard plates being positioned to define a path therebetween for movement of a carton therethrough.

19. The invention as defined in claim 18 wherein said guard plates comprise a first portion mounted to said side arms and a second portion transversely adjustably mounted to said first portion.

20. The invention as defined in claim 18 wherein each of said guard plates further includes a contact surface extending along at least a portion thereof closest to said path for guiding a carton through said apparatus.

21. The invention as defined in claim 20 wherein said contact surfaces are a low friction material.

22. The invention as defined in claim 16 further comprising a carton urging assembly mounted to said frame structure for moving a carton from a first position wherein said carton is engaged by said bottom flap folder assembly to a second position wherein said carton is engaged by said endless conveyor belts for traversing the carton through said carton sealing apparatus.

23. The invention as defined in claim 22 further including an actuator for moving said carton urging assembly from said first position to said second position.

24. The invention as defined in claim 16 further including a top sealing head mounted to said frame structure for applying a seal to a carton having top flaps being in an infolded position, said top sealing head having a hold-down flange mounted thereto for contacting said carton and maintaining contact between said carton and said horizontal plate during infolding of said carton bottom flaps.

* * * * *